United States Patent [19]

Scott et al.

[11] Patent Number: 5,058,688

[45] Date of Patent: Oct. 22, 1991

[54] CONVERTIBLE VIBRATORY OR ROTARY CORE DRILL APPARATUS

[75] Inventors: Hugh Scott, Wellington; John Porritt, Picton, both of Canada

[73] Assignee: Meta-Probe Inc., Picton, Canada

[21] Appl. No.: 612,439

[22] Filed: Nov. 14, 1990

Related U.S. Application Data

[63] Continuation-in-part of Ser. No. 338,716, Apr. 14, 1989, Pat. No. 5,004,055.

[51] Int. Cl.[5] ..... E21B 7/00; E21B 7/24

[52] U.S. Cl. ..... 175/20; 175/55; 175/87; 175/122; 175/170; 175/203

[58] Field of Search ..... 175/20, 55, 122, 135, 175/170, 202, 203, 244, 87, 195; 166/77.5, 85, 102; 173/29, 49

[56] References Cited

U.S. PATENT DOCUMENTS

| | | | |
|---|---|---|---|
| 2,848,196 | 8/1958 | Simmonds . | |
| 2,914,305 | 11/1959 | Wink . | |
| 3,011,570 | 12/1961 | Kurt et al. | 175/122 |
| 3,106,258 | 10/1963 | Muller . | |
| 3,179,186 | 4/1965 | Bull | 175/87 |
| 3,402,621 | 9/1968 | Johnson et al. . | |
| 3,696,873 | 10/1972 | Anderson . | |
| 3,714,996 | 2/1973 | Dane, Jr. . | |
| 3,910,358 | 10/1975 | Martinek . | |
| 4,232,752 | 11/1980 | Hauk et al. . | |
| 4,553,443 | 11/1985 | Rossfelder et al. . | |
| 4,585,080 | 4/1986 | Bender | 175/170 |

FOREIGN PATENT DOCUMENTS 1163985 3/1984 Canada .

OTHER PUBLICATIONS

"Equipment and Techniques for Offshore Survey and Site Investigations", P. G. Sly, Canadian Geotechnical Journal, vol. 18, No. 2-1981, pp. 230-249.

"Evaluation of Equipment and Processes to Sample Offshore Placer Deposits from Small Fishing Vessels", Nordco Limited, Dec., 1986, pp. 36-87.

*Primary Examiner*—Bruce M. Kisliuk

*Attorney, Agent, or Firm*—Barrigar & Oyen

[57] ABSTRACT

A convertible drill apparatus for applying force to a probe capable of operating in either a vibratory drilling mode wherein the apparatus is adapted to drive the probe into the material to be drilled or a rotary drilling mode wherein the apparatus drives the probe into the material to be drilled by rotation of the probe. The apparatus comprises a drill stand, vibratory drive for imparting a vibratory motion to the probe, rotary drive for imparting a rotary movement to the probe, a vibratory drive probe coupling for coupling the probe to the vibratory drive, a rotary drive probe coupling for coupling the probe to the rotary drive, a support for supporting and containing the coupling, a carriage assembly for mounting the support to the drill stand in sliding up and down fashion, and carriage drive for lifting or lowering the carriage assembly. The invention can be easily converted from vibratory drilling modes to rotary drilling modes and back by exchanging the vibratory drive with the rotary drive. By converting from vibratory drilling mode to rotary drilling mode, the drill apparatus can drive the probes through rock, soil, asphalt or other material which would hamper vibratory drilling alone.

14 Claims, 10 Drawing Sheets

CONVERTIBLE VIBRATORY OR ROTARY CORE DRILL APPARATUS

This application is a continuation-in-part application of application Ser. No. 338,716, filed Apr. 14, 1989 now Pat. No. 5,004,055.

BACKGROUND OF THE INVENTION

This invention relates to a vibratory core drill apparatus for applying force to a sampling tube for the recovery of soil and sediment samples.

Recent trends in environment monitoring and pollution control have called for core sampling mechanisms which can deliver large diameter uncontaminated sediment and soil land fill profile cores. The fields of agriculture, engineering and mineral exploration also require large diameter undisturbed soil and sediment profile cores for structure and chemical analysis. Representative soil or sediment samples are often required at depths of up to twenty meters of overburden comprising sediments 25–80% solids.

The use of high frequency core sampling techniques facilitates the collection of sediment cores with minimal disruption of the circumference layer and without serious compaction or de-watering of the sample. Piston or gravity drive sampling systems including split spoons or shelby tubes often fail to deliver undisrupted and representative sediment or soil samples. Wink discloses a vibratory drill apparatus in Canadian Patent No. 1,163,985, but this apparatus suffers from many drawbacks. The Wink drill is hand held and underpowered, therefore the drill has a very limited penetration depth and is awkward to use. The Wink drill vibrates while it is in operation and, being hand held, the vibration of the Wink results in trauma to the arms of the operator. Furthermore, the Wink drill yields soil and sediment samples which are not truly representative due to the fact that the operator cannot apply a uniform downward force results in bullnosing or collection of an unrepresentative sample due to temporary blockage of the core tube by stiffer material in the sedimentary sequence.

The Wink drill does not permit the coupling and uncoupling of sampling tubes without first disconnecting the vibrator from a flexible power shaft or hydraulic line. This inability makes the operation of such vibratory drill slow, tedious and awkward. Furthermore, this drawback renders the use of a drill stand for mounting and steadying the vibratory drill, as well as a drive means for driving the sampling tube down into the ground, impractical.

Yet another problem with the prior art rested in the vibrators themselves. The amplitude of the vibration produced by the said vibrators were not adjustable, furthermore, the frequency of vibration produced was difficult to regulate. Said prior art therefore, could not adjust the nature of the vibrations produced by their vibrators to match the soil or sediment conditions. As a result, said prior art yielded lower quality, less representative, soil or sediment samples.

Mount U.S. Pat. Nos. 3,301,336 and 3,352,160, discloses vibratory core sampling apparatus suffering many of the above mentioned drawbacks.

SUMMARY OF THE INVENTION

The present invention discloses a vibratory core drill apparatus for obtaining soil or sediment samples comprising a drill stand, a carriage assembly mounted within the drill stand in a vertically sliding fashion, carriage drive means for driving the carriage assembly up and down, vibratory drive means for applying a vertical vibratory force to the sampling tube, coupling means for coupling and decoupling the sampling tubes to the vibratory drive means without rotation of the vibratory drive means, and support means for supporting and restraining the coupling means and vibratory drive means within the carriage assembly.

The coupling means comprises a fixed member which is rigidly mounted to the vibratory drive means and a revolving member which is rotatably mounted to the fixed member. The revolving member is able to rotate freely in either the clockwise or counter-clockwise direction and is capable of coupling to the sampling tubes.

The vibratory drive means may comprise a pair of eccentric cams mounted to a drive shaft at a variable angle to each other, both being contained within a housing. Such vibratory drive means may be caused to vibrate by the rotation of the drive shaft, and the magnitude of the vibrations may be controlled by varying the angle between the cams. The said drive shaft may be rapidly rotated by a high speed hydraulic motor.

The support means may comprise an annular member having two side arms pivotally connected to the carriage assembly, the coupling means resting within the hollow of the annular member.

The carriage drive means may comprise a hydraulic drive motor connected to a shaft, wherein the rotation of the shaft lowers or raises the vibratory means and coupling means by means of a pair of chains attached to the vibratory means or coupling means. The carriage drive means is adapted to exert a uniform downward force onto the sampling tubes.

The apparatus may further comprise a hydraulic power means providing hydraulic power of the operation of both the carriage dive means and the vibratory drive means, wherein the hydraulic power means comprises a hydraulic pump for pumping hydraulic fluid, a motor for driving the hydraulic pump, a reservoir for storing hydraulic fluid, and a control module all contained as a separate unit capable of being disassembled for easy transportation.

The apparatus herein described is much easier to operate and suffers few of the drawbacks of the prior art. The present invention avoids these drawback whilst maintaining the ability to collect large diameter undisturbed and uncontaminated sediment and soil/land fill profile cores.

The presently preferred embodiment of the invention consists of a drill apparatus which is convertible between vibration drilling and rotary drilling. The apparatus is capable of driving a variety of drill probes, such as hollow sampling tubes, augers, split spoons, or even pilings, by applying either a vibratory force or a torsional force to the appropriate probe. This convertible drill apparatus includes a drill stand, a carriage assembly mounted to the stand in a vertically sliding fashion, and a carriage drive means for driving the carriage assembly up and down by application of vertical force thereto. A vibratory drive means is removably mountable within the carriage assembly. The vibratory drive means applies a vertical vibratory force to the appropriate probe when the vibratory drive means is mounted within the carriage assembly. A rotary drive means is removably mountable within the carriage assembly for applying a torsional force to the probe when the rotary drive means is mounted within the carriage assembly. The apparatus also comprises a vibratory drive probe coupling means mounted to the vibratory drive means for coupling and decoupling the probe to the vibratory drive means. Likewise, a rotary drive probe coupling means is mounted to the rotary drive means for coupling and decoupling the probe to the rotary drive means. The rotary drive means and the vibratory drive means are interchangeable to permit the apparatus to be converted between rotary and vibrational drilling, respectively. Lastly a support means is mounted within the carriage assembly for supporting the vibratory coupling means and the rotary coupling means within the carriage assembly.

The support means comprise a yoke having an annular portion sized to receive the vibratory coupling means and also sized to receive the rotary coupling means. The support means is provided with axial side arms pivotally mounted to the carriage assembly so as to allow the support means to pivot about the longitudinal axis of the side arms. The support means is dimensioned to loosely contain the vibratory coupling means so as not to dampen the vibratory motion of the vibratory means.

The rotary drive probe coupling means comprises a cylindrical central portion rotatably mounted within a hub. The hub is configured to fit snugly within the annular portion of the yoke and the cylindrical portion has a top end mountable to the rotary drive means and a bottom end mountable to the probe. The rotary drive probe coupling means is further adapted to permit rotation of the central cylindrical portion while being rigidly retained within the yoke.

The convertible drill apparatus may also comprise a fluid injecting means for cooling, flushing or lubricating a hollow probe in operation when the drill is converted to rotary drilling. The fluid injecting means may operate by injecting a stream of fluid down through the hollow probe.

The convertible drill apparatus may also comprise an evacuating means for evacuating a hollow probe to draw material up through the hollow probe.

Vibration drilling is quite acceptable for obtaining soil sample from unconsolidated soils or sediments or for driving pilings or other drill probes into overburden. The ability of the presently preferred convertible drill apparatus to operate in either a vibratory drilling mode or a rotary drilling mode enables the same drill rig to be used for a wide variety of applications and in a wide variety of material such as rock, concrete, soil or sediment. Also, the convertible feature of the presently preferred embodiment allows the operator to switch back and forth between rotary and vibrational drilling in the field and in the same drilling. This allows an operator to switch from vibration drilling to rotary drilling when a rock or other obstruction which cannot be penetrated by vibration drilling but which can be penetrated by rotary drilling is encountered. Also, using rotary drilling drive the convertible drill can drive the drill probe deeper into the overburden.

DESCRIPTION OF THE PREFERRED EMBODIMENT

The better understanding of the present invention may be had by reference to the following description of the presently preferred embodiment, taken in connection with the drawings. Vibratory core drill apparatus for obtaining soil and sediment samples in accordance with the present invention, is illustrated in FIGS. 1 through 7.

Figure 1:
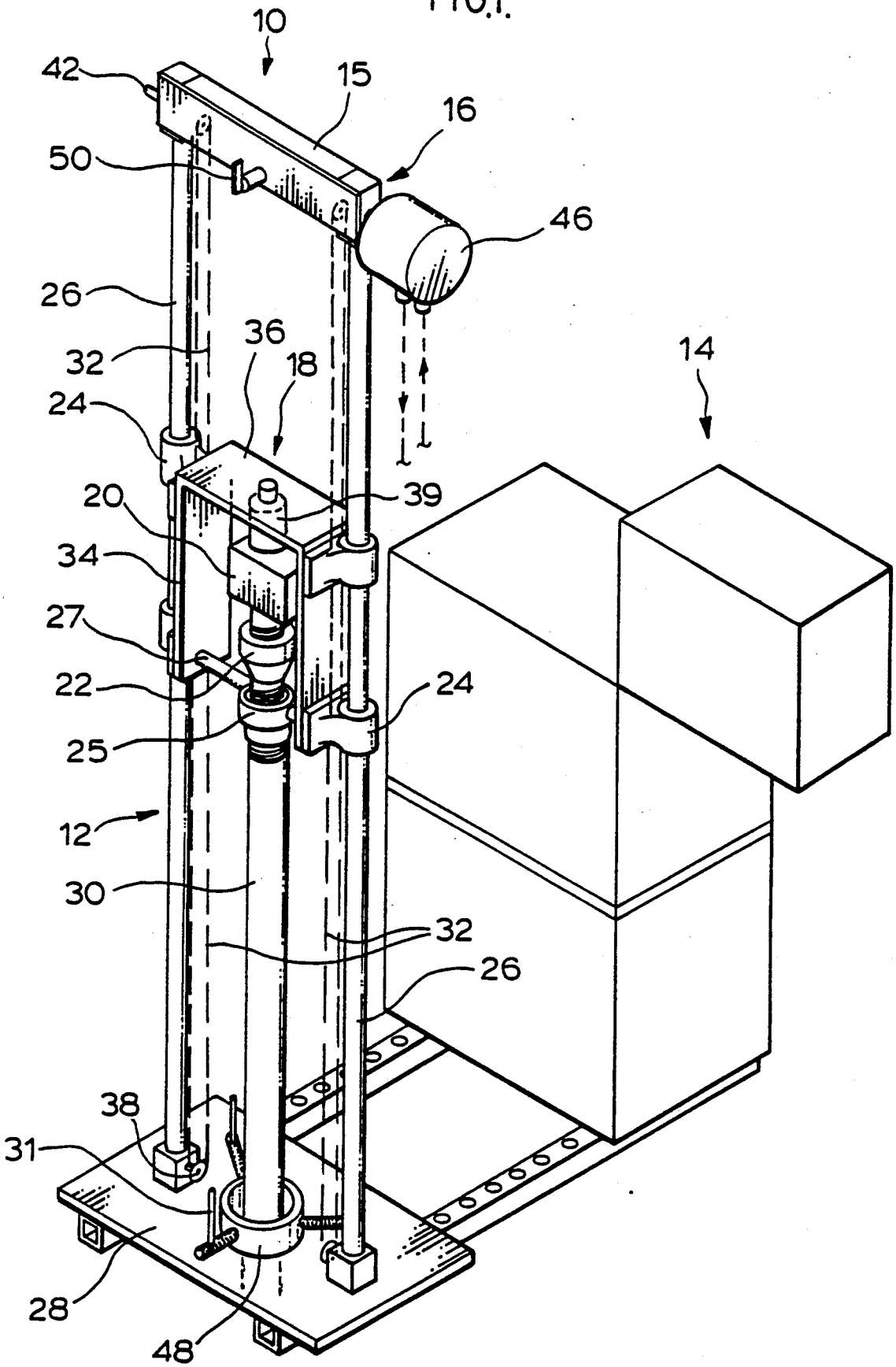
FIG. 1 is a perspective view of the apparatus of the present invention.
Figure 2:
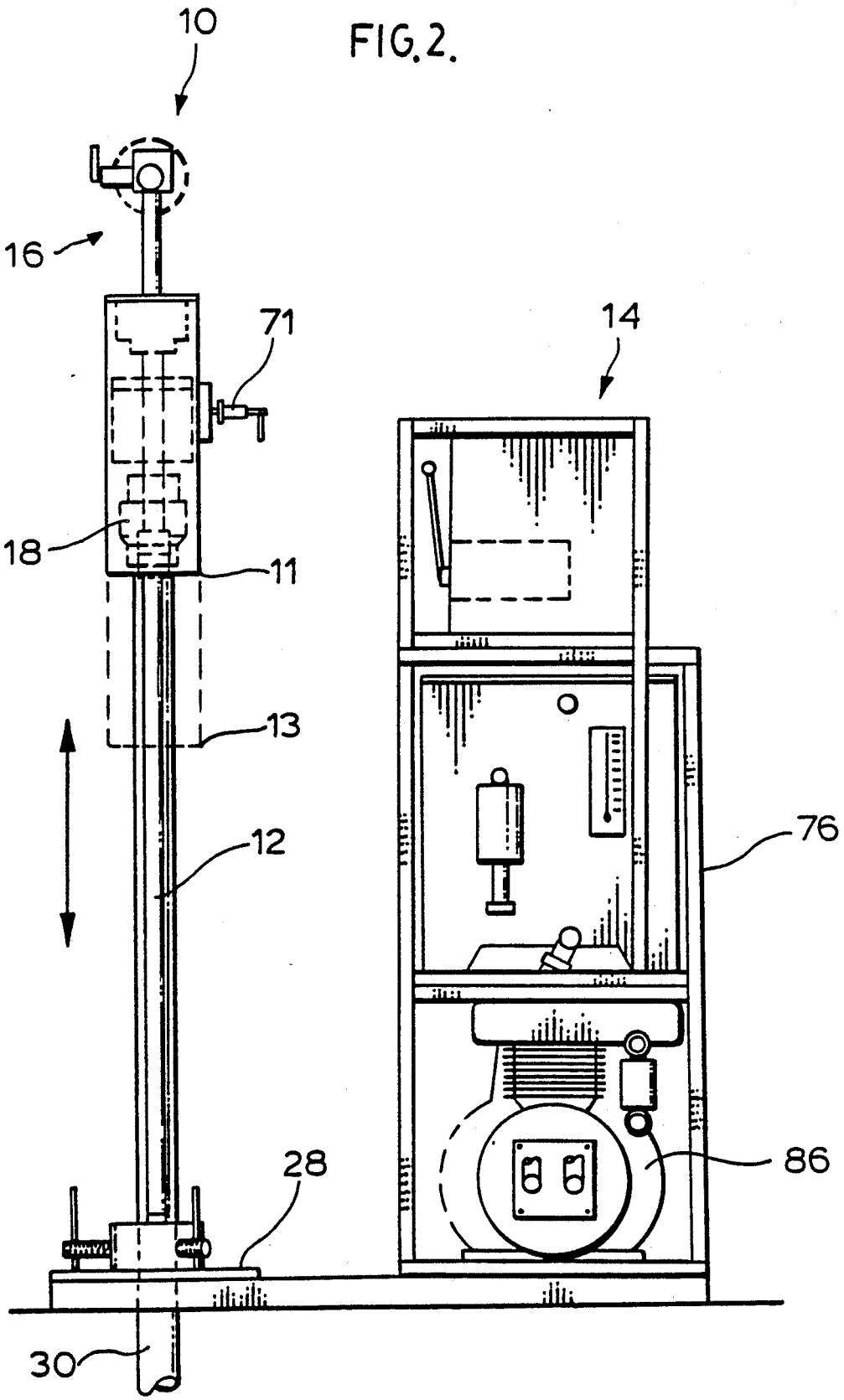
FIG. 2 is a side view of the said apparatus.
Figure 3:
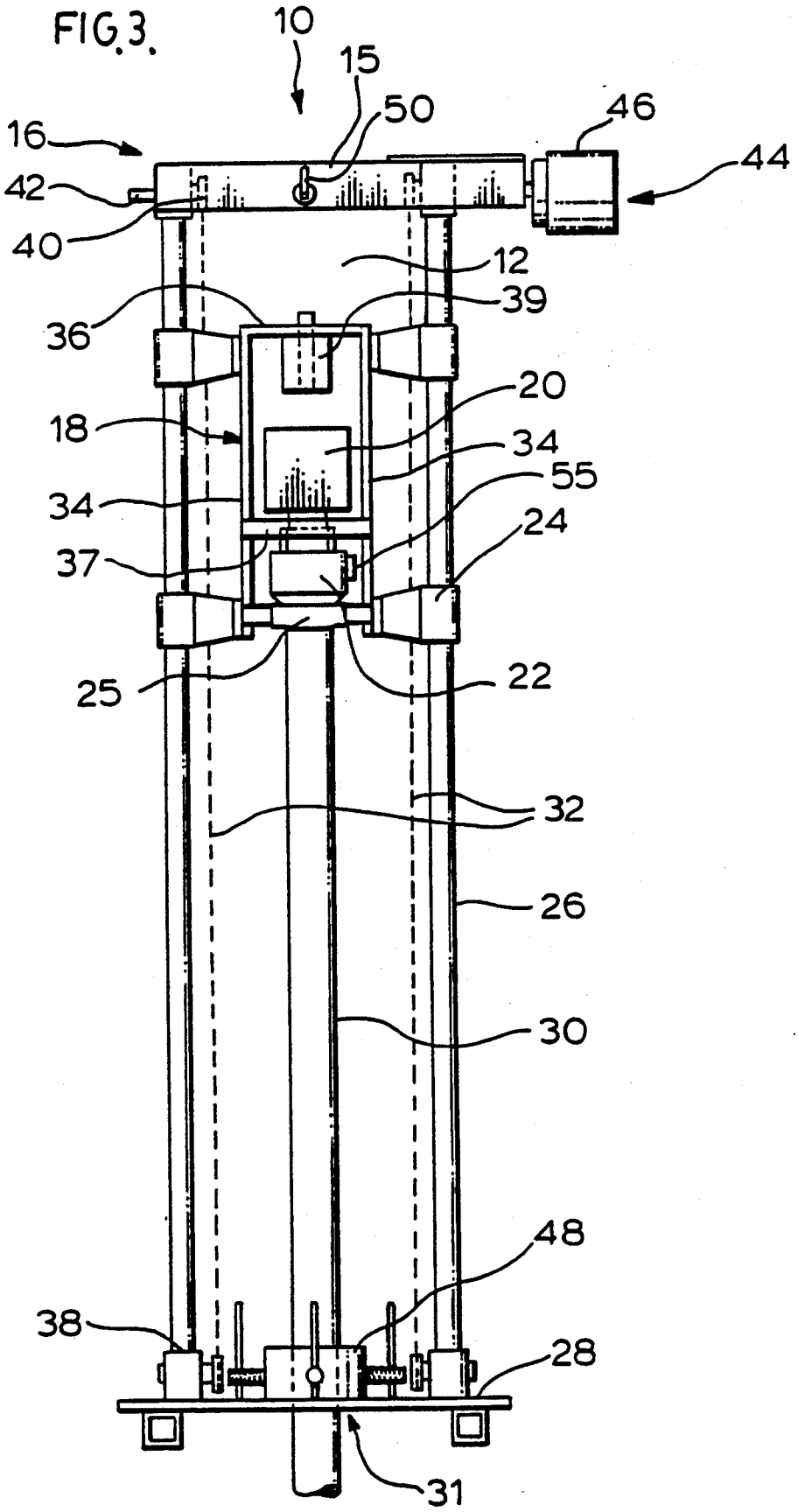
FIG. 3 a front elevational view of a portion of the apparatus of FIG. 1.

Referring to FIGS. 1, 2 and 3, the apparatus shown therein comprises a vibratory core drill shown generally as 10 and a hydraulic power means shown generally as 14. The vibratory core drill comprises a drill stand shown generally as 12, a carriage assembly 18 mounted within drill stand 12, vibratory drive means 20 and coupling means 22 mounted within the carriage assembly 18, carriage drive means shown generally as 16, and restraining means 48.

Drill stand 12 comprises a pair of vertical side members 26, base plate 28, and head frame 15. Base plate 28 has an opening 31 to permit the travel of sample tube 30. Immediately above opening 31 and mounted to base plate 28 is rod restraining means 48 which serves to support and steady sample tube 30 within drill stand 12, during operation of the drill.

Carriage assembly 18 comprises a frame having side members 34, top member 36 and cross bar 37. Support means 25 is pivotally mounted between the lower inside surfaces of side member 34. Vibratory drive means 20 is mounted atop coupling means 22, adaptor 23 is mounted beneath coupling means 22, and coupling means 22 and adaptor 23 are in turn mounted within support means 25. Snubber 39 is mounted to top frame member 36 and cushions the vibratory drive means 20 from contact with top member 36. Sliders 24 are mounted at one end to the outside faces of side member 34 adjacent the corners of carriage assembly 18. At their other ends, sliders 24 are slidingly mounted to side member 26 of drill stand 12 so as to permit the carriage assembly to slide up and down from a position of full retraction 11 to a position of full extension 13, as shown in FIG. 2.

Carriage drive means 44 comprises shaft 42 mounted within head frame 15 of drill stand 12, hydraulic motor 46 connected to drive shaft 42 and mounted to head frame 15, upper sprockets 40 mounted to shaft 42, lower sprockets 38 mounted near base plate 28, and roller chains 32 which travel between upper sprockets 40 and lower sprockets 38. Roller chains 32 are coupled to the carriage assembly 18 by attachment to sliders 24. Operation of the hydraulic motor 46 causes the spinning of shaft 42 which in turn raises or lowers carriage assembly 18.

Figure 5:
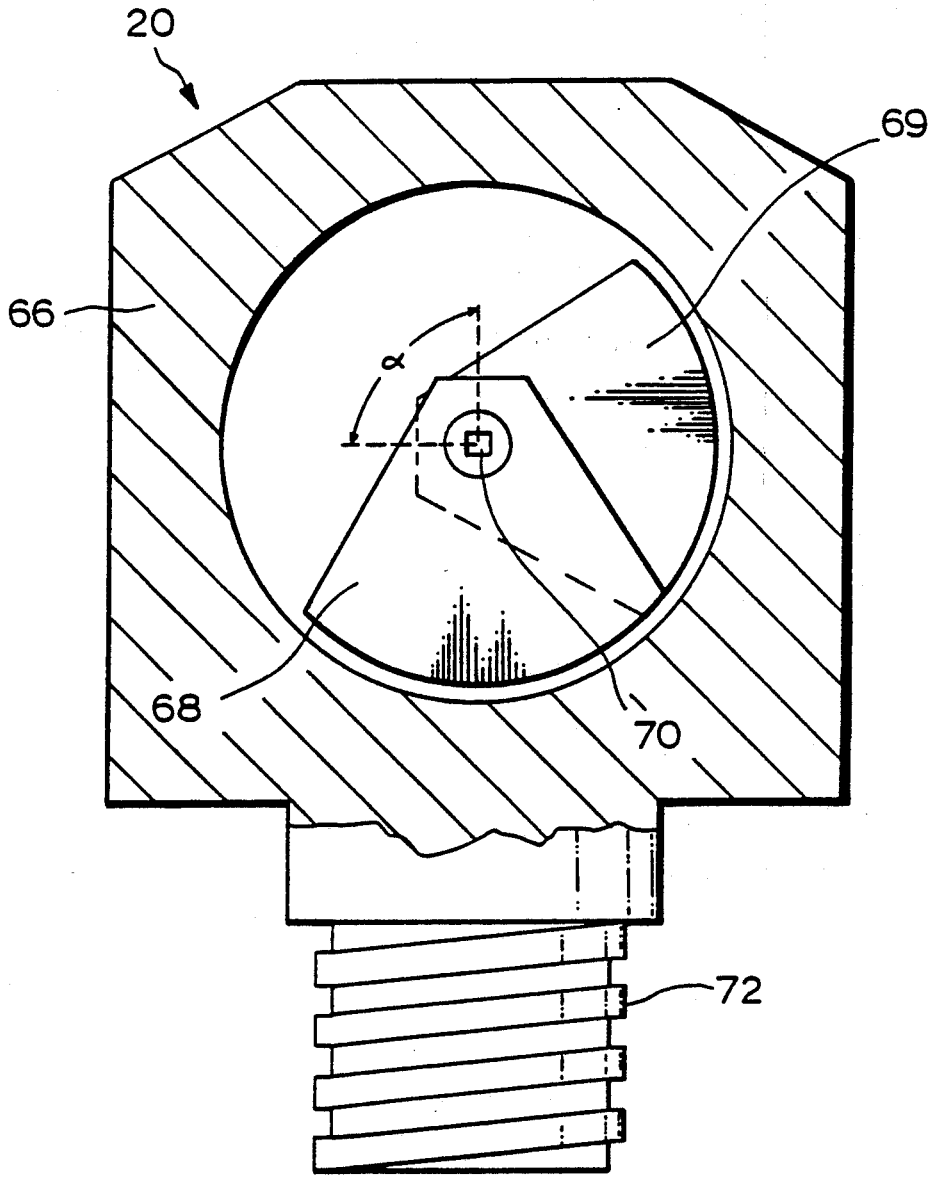
FIG. 5 a cross-section view through the vibratory drive means of the apparatus in FIGS. 1 and 2.

With primary reference to FIGS. 2 and 5, vibratory drive means 20 comprises eccentric cams 68 and 69 which are mounted onto shaft 70 with housing 66. Hydraulic motor 71 is connected to shaft 70. Eccentric cams 68 and 69 are positioned on shaft 70 at a variable angle alpha relative to each other. Eccentric cam 69 is thicker and heavier than eccentric cam 68. Threaded lower portion 72 serves to attach vibratory drive means 20 to coupling means 22. The operation of hydraulic motor 71 causes the spinning of shaft 70 and in turn causes vibration due to the revolving of the eccentric cams. The amplitude of the vibration can be varied by changing the variable cam angle alpha. When alpha equals 180 degrees the eccentric cams are counter opposed and, therefore, the spinning of shaft 70 result in minimal amplitude of vibration. Maximal amplitude of vibration results from the lowering of the available cam angle alpha to zero degrees.

Figure 4:
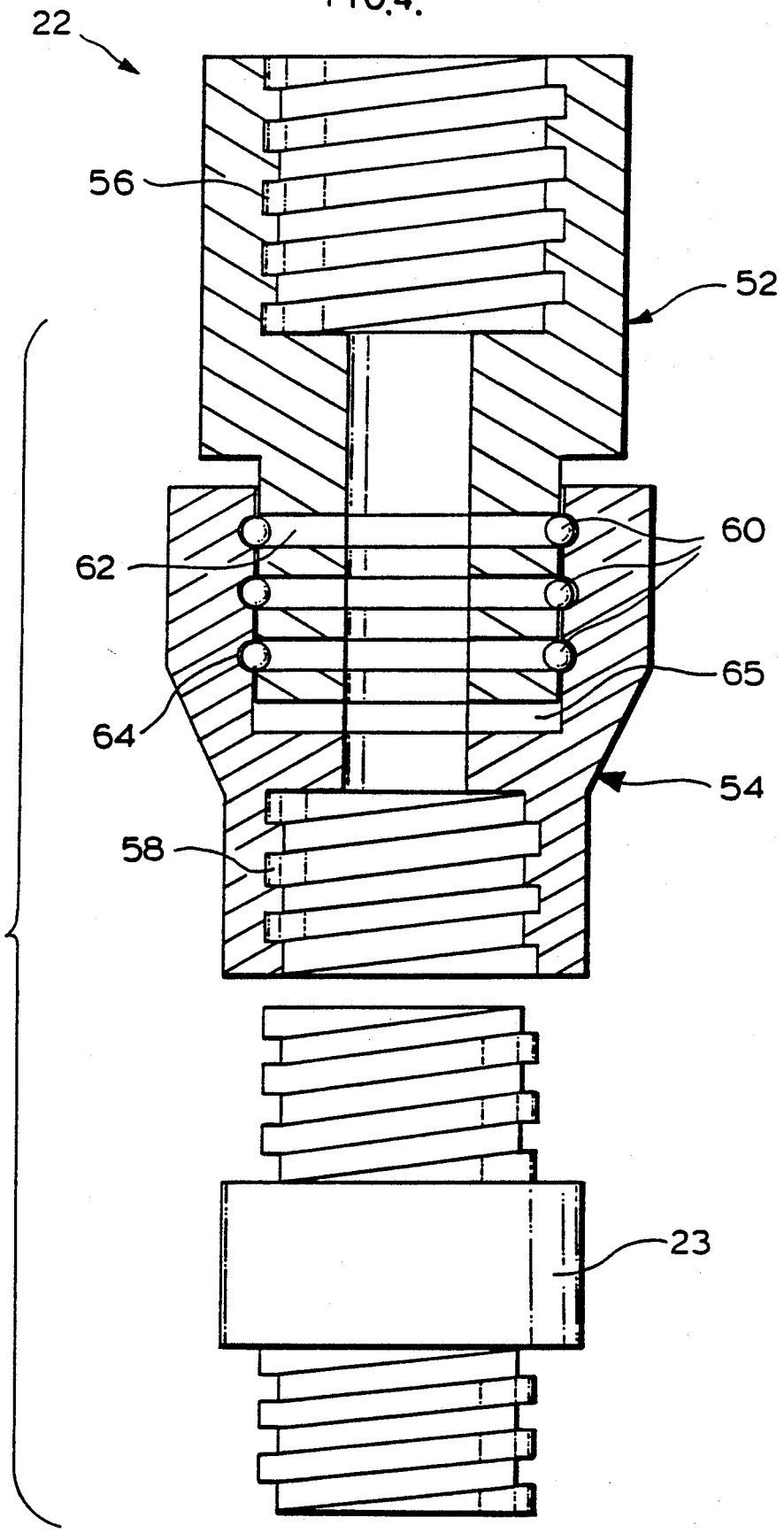
FIG. 4 is a cross-sectional view through the coupling means in the apparatus of FIGS. 1 and 2.

Referring now primarily to FIG. 4, coupling means 22 comprises fixed member 52 and rotatable member 54 mounted below fixed member 52. Fixed member 52 is attached to the threaded lower portion 72 of vibratory means 20 shown in FIG. 5 by a threaded upper portion 56. The upper portion of rotatable member 54 fits over the lower portion along the periphery of the lower portion of fixed member 52 and bearing races 64 are cut along the inside surface of the upper portion of rotatable member 54. Ball bearings 60 ride within the bearing races 62 and 64 between fixed member 52 and rotatable member 54 Ring seal 65 separates the bottom most portion of fixed member 52 from rotatable member 54. Plug 55 shown in FIG. 3 serves to seal an opening (not shown) extending perpendicularly through one wall of rotatable member 54 through which oil or grease may be injected for lubrication of ball bearings 60. Rotatable member 54 has a female threaded lower end having threads 58 which permit male to male adaptor 23 to be screwed into rotatable member 54. Rotatable member 54 is then connectable to sampling tubes by connecting male adaptor 23 to sampling tubes and then rotating rotatable member 54. Because rotatable member 54 can rotate freely relative to fixed member 62, sampling tubes may be connected to the coupling means without having to rotate fixed member 52.

Figure 6A:
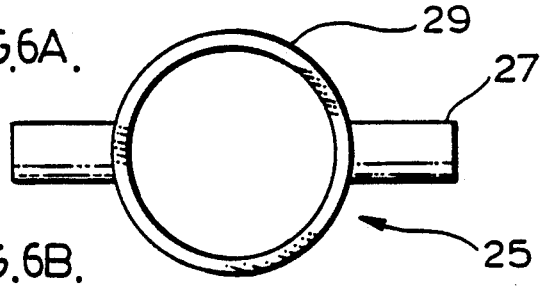
FIG. 6*a* is top view of the support means.
Figure 6B:
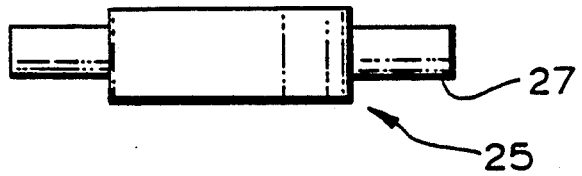
FIG. 6*b* is a side view of the support means.

Referring to FIGS. 1, 6*a* and 6*b*, support means 25 comprises an annular portion 29 and side arms 27. Side arms 27 are pivotally mounted directly to the side portions 34 of carriage assembly 18. The inside diameter of annular or ring portion 29 is slightly greater than the outside diameter of the lower portion of rotatable member 54 enabling the lower portion of rotatable member 54 to sit within support means 25. Male adaptor 23 fits within the hollow of annular portion 29.

Support means 25 provides support to coupling means 22 when carriage assembly 18 is being raised. Support mean 25 also helps restrain sample tube 30. Furthermore, when in place, support means 25 allows vibratory drive means 20 and coupling means 22 to be angularly displaced relative to carriage assembly 18 by pivoting about the longitudinal axis of side arms 27. This angular displacement of vibratory drive means 20 and coupling means 22 provides for easier attachment of sampling tubes 30.

Figure 7:
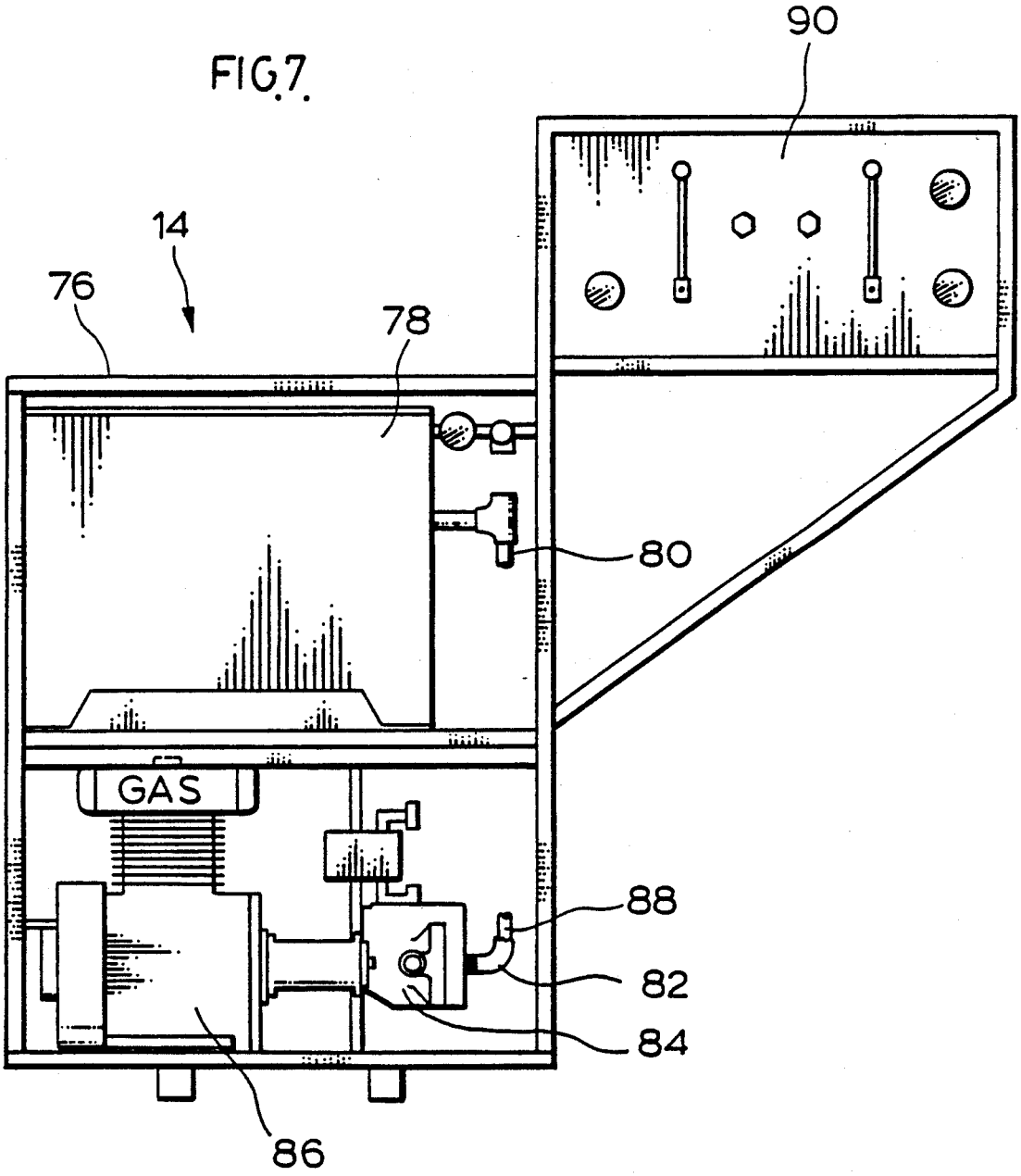
* FIG. 7 is a front elevation in section of a portion of the apparatus of FIG. 1.

Referring to FIG. 7, hydraulic power means 14 comprises reservoir 78 for storing hydraulic fluid, hydraulic pump 84 for pumping hydraulic fluid to a high pressure, a prime mover such as engine 86 for operating the hydraulic pump 84, and control module 90 for regulating the hydraulic pressure supplied to hydraulic motor 71 and hydraulic motor 46. Engine 86 may be either a gasoline or diesel engine. Frame 76 mounts engine 686 and hydraulic pump 84 beneath reservoir 78; control module 90 is also mounted to frame 76. Flexible hose 80 transports hydraulic fluid to inlet 82 while outlet 88 permit pressurized hydraulic fluid to be transported via flexible hoses to control module 90. Flexible hoses then carry the pressurized hydraulic fluid from control module 90 to both hydraulic motor 46 and hydraulic motor 71. Other flexible hoses carry depressurized hydraulic fluid back to reservoir 78. Frame 76 may be disassembled for easy transportation into three separate units containing reservoir 78, engine 86 and hydraulic pump 84, and control module 90 respectively.

The operation of the vibratory core drill apparatus of the present invention will now be described. Prime mover 86 is activated, and hydraulic pump 84 pressurizes a quantity of hydraulic fluid which makes its way to hydraulic motors 71 and 46. Control module 90 modulates the flow of pressurized hydraulic fluid to hydraulic motors 71 and 46. The first sampling tube 30 is then coupled to coupling means 22 while carriage assembly 18 is in its fully retracted position and fitted through rod restraining means 48. Vibratory drive 20 is then made to vibrate at approximately 200 hz by the flow of hydraulic fluid through hydraulic motor 71. Carriage drive means 44 is then activated to lower carriage assembly 18 with sufficient force so as to cause the rapidly vibrating sample tube 30 to penetrate the soil, snubber 39 restraining the upward movement of the vibratory drive means 20. Rod restraining means 48 and support means 25 guide and steady sample tube 30 as it penetrates the soil. For deeper penetration, sample tube 30 is disconnected from male adaptor 23 extending from coupling means 22 by rotation of rotatable member 54, and the carriage assembly 18 is fully retracted. Then, another sample tube is screwed onto male adapter 23, after pivoting coupling means 22 towards the operator if desired, and the new sample tube is screwed onto the sample tube n the ground by rotation of rotatable member 54. The carriage assembly 18 is then forcibly lowered by operation of carriage drive means 44, so as to drive the additional sample tube section into the soil. This procedure can be repeated several times to obtain penetration depths of up to twenty meters. The samples can be retrieved by reversing the procedure. Very accurate and representative soil core samples may be obtained by regulating the amplitude of vibration and the rate of sample tube penetration.

The presently preferred embodiment of the invention is a dual mode drill apparatus convertible between a vibratory drilling mode and a rotary drilling mode. In its vibratory drilling mode, the presently preferred embodiment is identical to the vibratory core drill already described.

Figure 8:
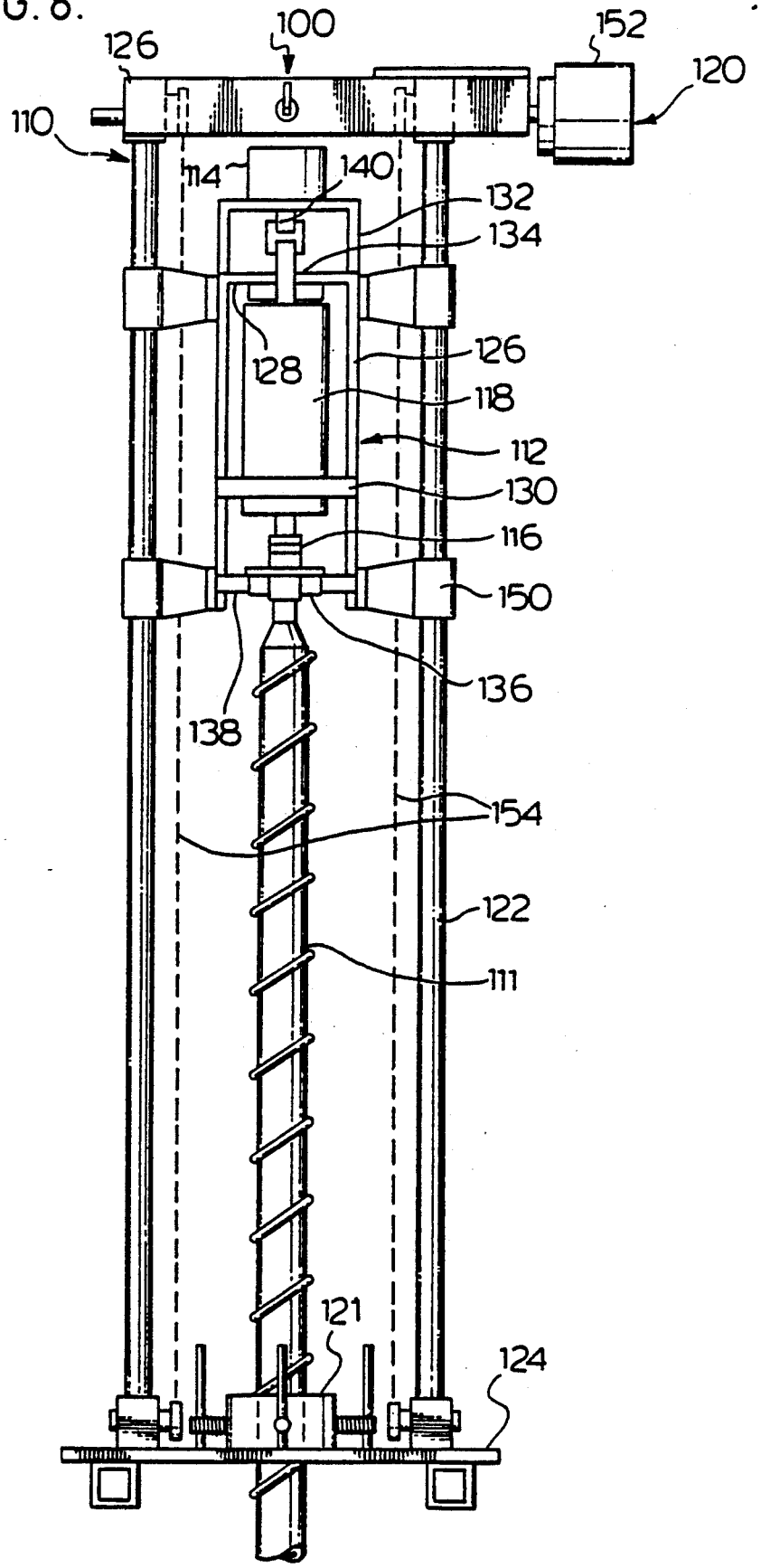
FIG. 8 is a front elevational view of the presently preferred embodiment of the invention, shown in its rotary drilling mode.

Referring to FIG. 8, the presently preferred convertible drill apparatus in its rotary drilling mode is shown generally as 100 and comprises a drill stand shown generally as 110, a carriage assembly 112 mounted within drill stand 110, rotary drive means 114, rotary coupling means 116, fluid injecting means 118, carriage drive means shown generally as 120, support means 136, restraining means 121 and probe 111.

Probe 111 could be any one of a variety of drill probes currently available on the market, depending on the application desired. Probe 111 could be a hollow sample tube for obtaining soil or sediment samples, a hollow or solid auger, a cylindrical drill tube with diamond drill bit for drilling through solid rock, or even a piling. The type of probe used is dependant on the nature of the material to be drilled through and the mode of drilling selected. For rotary drilling, probe 111 may comprise a hollow auger, a solid auger, a hollow sample tube, or even a solid piling. For vibration drilling, a hollow sample tube or a piling would suffice but an auger would not be appropriate.

Drill stand 110 comprises a pair of vertical side members 122, base plate 124, and head frame 226. Drill stand 110 is identical to drill stand 12 of the previously described embodiment. Carriage assembly 126 is slidingly mounted on to side members 122 via sliders 150.

Carriage drive means 120 is identical to carriage drive means 16 of vibratory core drill 10 as previously described and comprises hydraulic motors 152, and drive chains 154.

Figure 9:
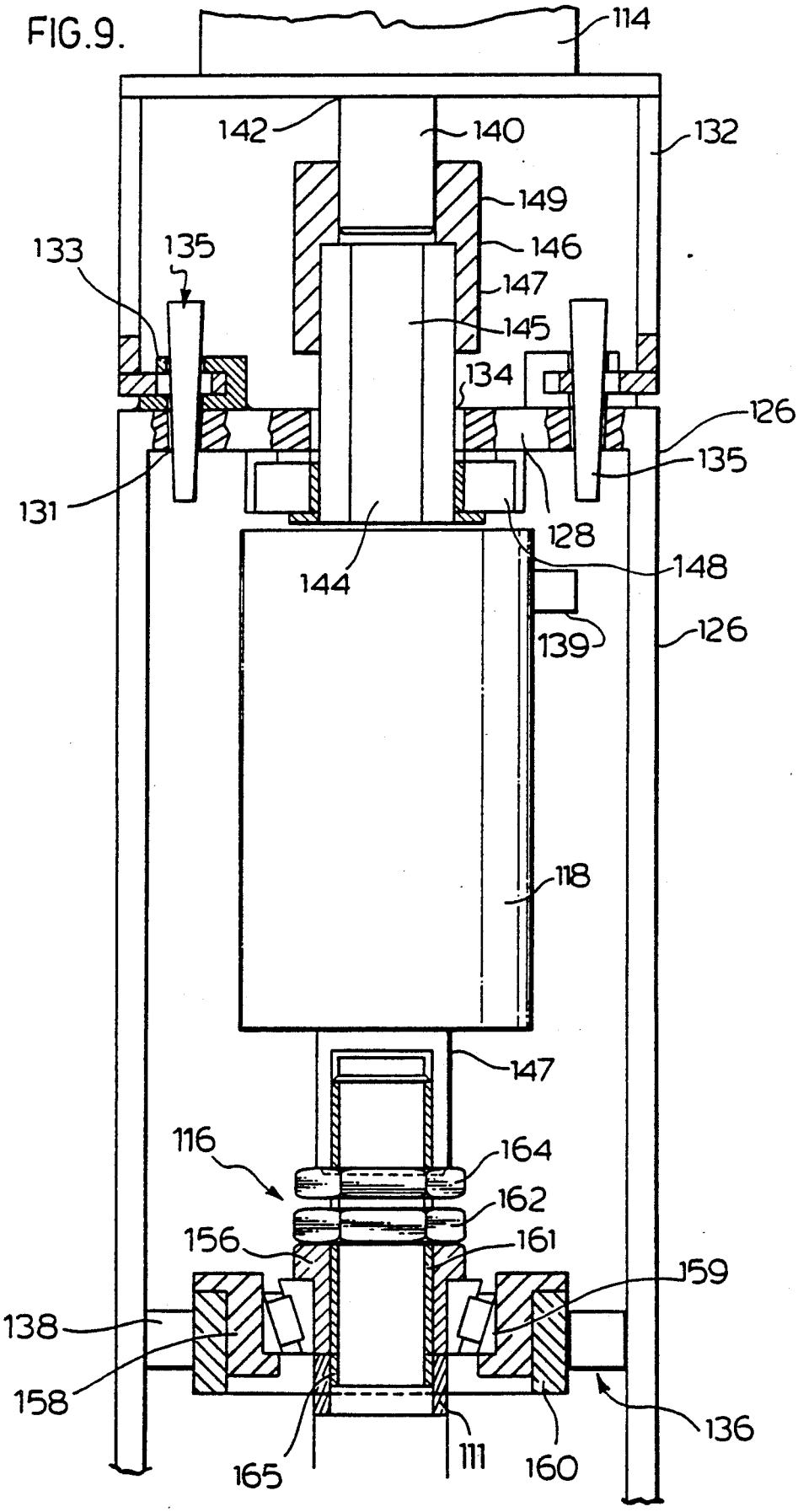
FIG. 9 is a front elevation view partially in cross-section of a portion of the apparatus of FIG. 8.

Referring now to FIG. 9, carriage assembly 112 comprises a frame having side members 126, top member 128, cross-bar 130, and carriage extension 132. Top member 128 is provided with aperture 134 and apertures 131, and carriage extension 132 is provided with apertures 133. Apertures 131 and 133 are aligned when carriage extension 132 is mounted to top member 228. Pegs 135 are inserted in apertures 131 and 133 to secure carriage extension 13 to top member 128. With the exception of carriage extension 132, carriage assembly 112 is otherwise identical to carriage assembly 18 of vibratory core drill 10 as previously described.

Rotary drive means 114 is mounted atop carriage extension 132 and has a drive shaft 140 which extends through aperture 142 in carriage extension 132. Fluid injection means 118 is interposed between rotary drive means 114 and rotary drive probe coupling means 116. Fluid injection means 118 has central shaft (not shown) which is connected to drive shaft 140 at its top end 145 and to coupling means 116 at its bottom end 147. Shaft coupler 146 connects drive shaft 140 to top end 145 of the central shaft. Top end 145 of the central shaft is hexagonal and shaft coupler 146 has a bottom portion 147 which has a female hexagonal configuration adapted to fit snugly over top end 145 of the central shaft. Shaft coupler 146 is slidingly mounted to shaft 140 at top portion 149 to permit quick and easy connection of shaft 140 to top end 145 of the central shaft.

Bearing 148 is interposed between fluid injecting means 118 and top member 128. Bearing 148 is mounted onto top end 145 of the central shaft and permits fluid injecting means 118 to bear against top member 128 while permitting the free rotation of top end 145 of the central shaft.

Rotary drive means 114 is a standard hydraulically powered rotary motor which is supplied with high pressure hydraulic fluid via flexible hoses. When hydraulic fluid is flowed through rotary drive means 114 with sufficient pressure, drive shaft 140 rotates.

Fluid injection means 118 comprises a standard fluid injection mechanism which is able to inject a stream of fluid through probe 111 provided of course probe 111 is hollow. Fluid injection means 118 also serves to flush out, cool or lubricate probe 111 during drilling. Bottom end 147 of the central shaft of fluid injection means 118 is mounted to rotary drive probe coupling means shown generally as 116, which is in turn supported by support means 136. Fluid injection means 118 is provided with an intake port 139 which is attachable to a fluid supply hose for supplying the fluid injection means with a fluid such as water. By attaching intake port 139 to a vacuum source, the unit can be used as an evacuating means for evacuating the hollow probe to draw material such as water up the probe.

Support means 136 comprises a yoke having axial side arms and an annular central portion 160 which is sized to snugly receive rotary drive probe coupling means 116. Support means 136 is pivotally mounted between the lower inside surfaces of side members 126 via side arms 138.

Coupling 116 comprises hub 158, roller bearing 159, collar 156, sleeve 161, and lower and upper ring nuts 162 and 164. Hub 158 is dimensioned to fit within annular portion 160 of support means 136. Roller bearing 159 is interposed between hub 158 and collar 156 to permit collar 156 to freely rotate within hub 158. Sleeve 161 is threaded on its outside surface and is screwed into collar 156, ring nuts 162 and 164, and bottom end 147 of the central shaft of fluid injection means 118. Ring nuts 162 and 164 may be separated by rotating in opposite directions thereby causing upper ring nut 164 to bear against bottom end 147 of the central shaft of the fluid injection means and ring nut 162 to bear against collar 156. When upper and lower ring nuts 164 and 162 are separated sufficiently, collar 156 is securely attached to bottom end 147 of the central shaft of fluid injection means 118 and hub 158 is rigidly held in annular portion 160. Rotation of bottom end 147 of the central shaft causes rotation of collar 156. Probe 111 is screwed onto sleeve 161 at the sleeves lowest extension 165. In the presently preferred embodiment of the subject invention, the bottom most extension 165 of sleeve 161 flairs out to permit its connection to wider probes.

Figure 10:
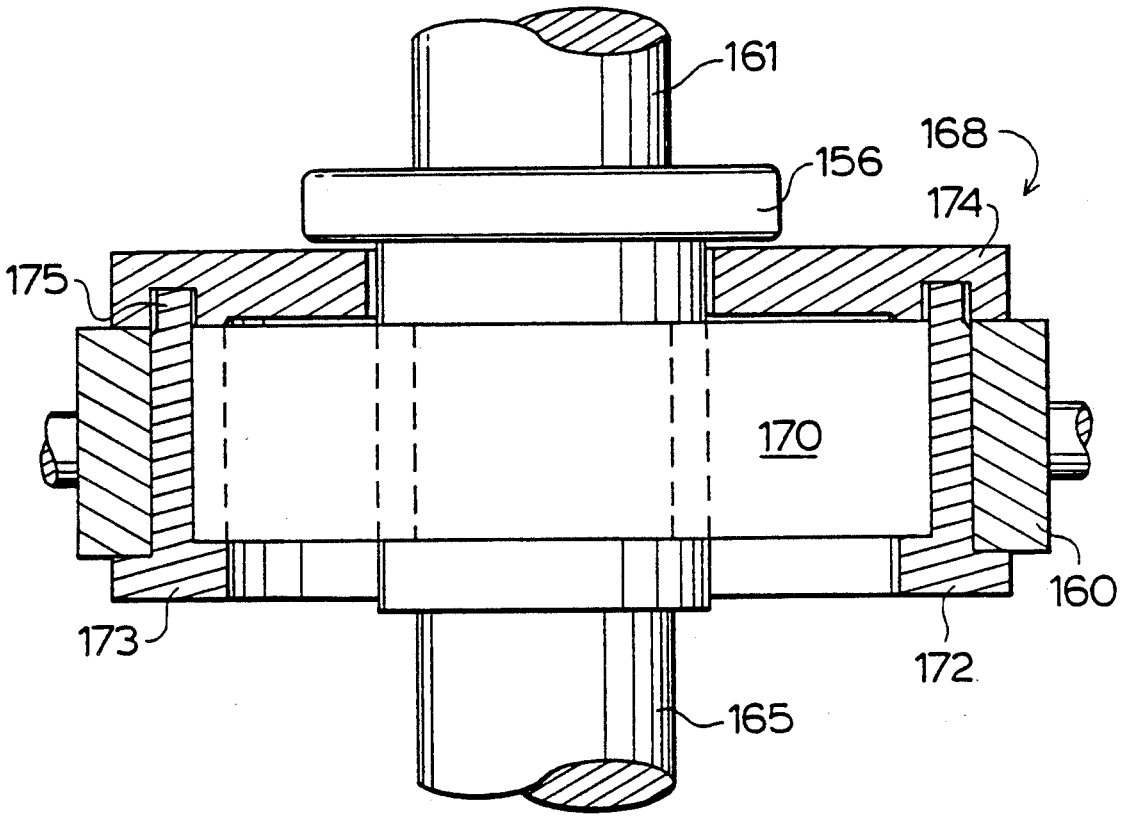
FIG. 10 is a cross-sectional view of an alternative embodiment of the rotary drive probe coupling means.

Referring now to FIG. 10, in an alternative embodiment of the present invention, rotary drive probe coupling means shown generally as 168 comprises collar 156, hub 170, top restraining member 174 and bottom restraining member 172. Collar 156 is as previously described and is rotatably mounted within hub 170. Hub 170 comprises a rotary bearing which permits collar 156 to freely rotate within hub 170. Hub 170 is rigidly retained within annular portion 160 by bottom restraining member 172 and top restraining member 174. Bottom restraining member 172 comprises a hollow cylindrical member which fits snugly within annular portion 160. Hub 170 is dimensioned to fit snugly within bottom restraining member 172. Bottom restraining member 172 has a bottom flared end 173 which prevents hub 170 from slipping out of annular portion 160. The top rim 175 of bottom restraining member 172 is rigidly mounted to top restraining member 174. With bottom restraining member 172 and top restraining member 174 in place, hub 170 cannot move relative to annular portion 160.

Figure 11:
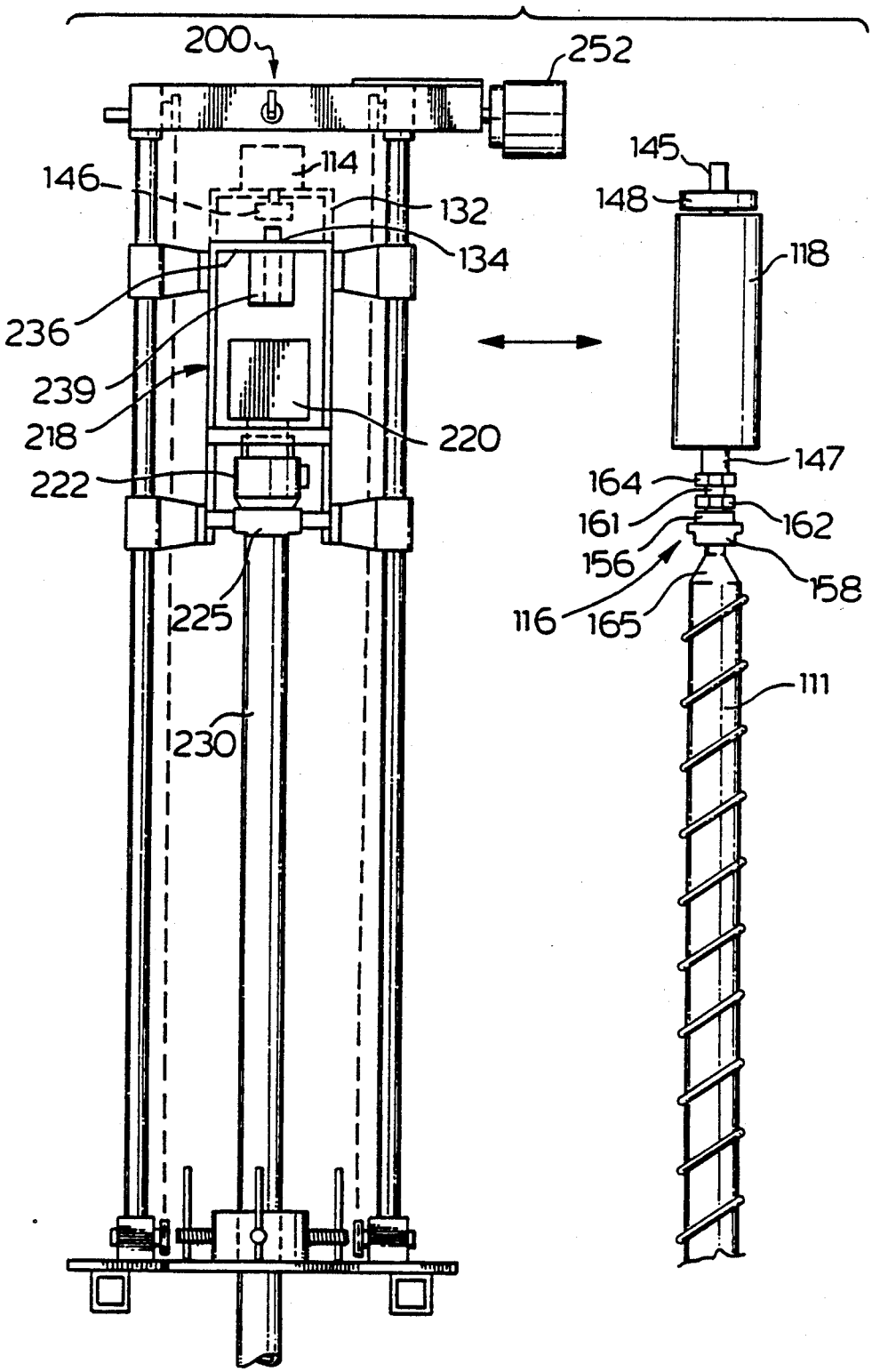
FIG. 11 is a front elevational view of the presently preferred embodiment of the invention, shown in its vibratory drilling mode together with the required parts for its conversion to rotary drilling.

Referring now to FIG. 11, the convertible drill apparatus in its vibratory drilling mode shown generally as 200 is identical to vibratory drill 10 as previously described and can be converted into its rotary drilling mode by the following steps.

First, sampling tube 230 is disconnected from vibratory coupling means 222 and vibratory coupling means 222, together with vibratory drive means 220, are removed from carriage assembly 218. Snubber 239 is then removed from top portion 236 of carriage assembly 218.

Secondly, carriage extension 132 is mounted to top portion 236 of carriage assembly 218. Rotary drive means 114 is then mounted to the top of carriage extension 132 such that shaft 140 extends through aperture 142 as previously described.

Bearing 148 is then inserted over top end 145 of the central shaft of fluid injection means 118 and top end 145 is inserted through aperture 134. Shaft coupler 146 is then lowered to snugly engage top end 145 of the central shaft as previously described.

Hub 158 together with collar 156 of rotary drive probe coupling means 116 are then inserted into support means 225. Sleeve 161 is then screwed through collar 156 to project through collar 156. Ring nuts 162 and 164 are then screwed onto sleeve 161. Sleeve 161 is then rotated further to screw into bottom end 147 of the central shaft of fluid injection means 118. Ring nuts 162 and 164 are then turned so as to separate them and cause fluid injection means 118 to bear slightly against bearing 148. Finally, an appropriate probe 111 is attached to bottom end 165 of sleeve 161, completing the conversion of the drill into its rotary drilling mode.

To commence rotary drilling, rotary drive means 114 is activated which causes shaft 140 to rotate with sufficient torque to cause rotation of probe 111. Hydraulic motor 252 is then activated and carriage assembly 218 is forcibly lowered, driving probe 111 towards the ground. The rotation of probe 111 causes it to penetrate the material, especially if probe 111 is an auger. Fluid injection means 118 can be activated to flow a stream of fluid down probe 111 to cool and lubricate probe 111. Once carriage assembly 118 is fully lowered, rotary drive means 114 can be deactivated and probe 111 can be decoupled from rotary drive probe coupling means 116. Carriage assembly 218 may then be raised and another section of probe 111 may be interconnected between rotary drive probe coupling means 116 and the segment of probe already in the ground. Rotary drive means 114 may then again be activated to cause rotation of probe 111 and hydraulic motor 252 can be activated to drive probe 111 further into the ground. This procedure can be repeated to obtain greater penetration depths.

The drill can be converted back to its vibratory drilling mode by disassembling fluid injection means 118, coupling means 116, rotary drive means 114, and carriage extension 132 from carriage assembly 218. Vibratory coupling means 222, vibratory drive means 220 and snubber 239 may then be remounted to carriage assembly 218. Therefore, it is possible to alternate between rotary and vibratory drilling modes in the same drilling by converting the drill 200 from rotary drilling mode to vibratory drilling mode or vice versa.

Accordingly, while the present invention has been described and illustrated with respect to the preferred embodiments, it will be appreciated that variations of the preferred embodiments may be made without departing from the scope of the invention, which is defined in the appended claims.

I claim:

1. Drill apparatus convertible between a vibrational drilling mode in which the apparatus is adapted to apply a vibrational force to a first drill probe and a rotary drilling mode in which the apparatus is adapted to apply a torsional force to a second drill probe comprising:

a) a drill stand;

b) a carriage assembly mounted to the stand in a vertically sliding fashion;

c) carriage drive means for driving the carriage assembly up and down by application of vertical force thereto;

d) vibratory drive means mountable within the carriage assembly for applying a vertical vibratory force to the first probe when the vibratory drive means is mounted within the carriage assembly;

e) rotary drive means mountable within the carriage assembly for applying a torsional force to the second probe when the rotary drive means is mounted within the carriage assembly;

f) vibratory drive probe coupling means mounted to the vibratory drive means for coupling and decoupling the first probe to the vibratory drive;

g) rotary drive probe coupling means mounted to the rotary drive means for coupling and decoupling the second probe to the rotary drive means;

h) the rotary drive means and the vibratory drive means being interchangeable to permit the apparatus to be converted between a rotary drilling mode and a vibrational drilling mode; and i) support means mounted within the carriage assembly for supporting the vibratory drive probe coupling means within the carriage assembly when the vibratory drive means is mounted therein and for supporting the rotary drive probe coupling means within the carriage assembly when the rotary drive means is mounted therein.

2. An apparatus as defined in claim 1, wherein the support means comprises a yoke having an annular portion sized to receive the vibratory drive probe coupling means and also sized to receive the rotary drive probe coupling means and having two axial side arms pivotally mounted to the carriage assembly so as to allow the support means to pivot about the longitudinal axis of the side arms.

3. The apparatus as defined in claim 2, wherein the rotary drive means has a rotary drive shaft and wherein the rotary drive probe coupling means comprises a hub configured to fit within the annular portion of the yoke, and a cylindrical central portion rotatably mounted within the hub, the cylindrical portion having a top end mountable to the rotary drive shaft of the rotary drive means, and a bottom end mountable to the probe, the rotary drive probe coupling means being adapted to hold the hub rigidly within the yoke.

4. The apparatus defined in claim 3, wherein the rotary drive probe coupling means is provided with a ring nut mounted on the cylindrical portion and for urging the cylindrical member against the hub so as to prevent movement of the hub within the yoke.

5. The apparatus defined in claim 3, wherein the rotary drive probe coupling means is provided with upper and lower thrust retaining members mounted on the yoke above and below the hub respectively, the retaining members rigidly holding the hub within the yoke.

6. An apparatus as defined in claim 3, further comprising fluid injection means interposed between the rotary drive means and the rotary drive probe coupling means for injecting fluid down hollow probes when the drill apparatus is in its rotary drilling mode, the fluid injection means having a central shaft rigidly mounted to the rotary drive shaft at one end and to the central portion of the rotary drive probe coupling means at its other end.

7. The apparatus defined in claim 6, wherein the fluid injecting means cools the probe by injecting a stream of fluid down the probe.

8. The apparatus defined in claim 6, wherein the fluid injecting means lubricates the probe by injecting a stream of fluid down the probe.

9. The apparatus defined in claim 6, wherein the fluid injecting means flushes out the probe by injecting a stream of fluid down the probe.

10. An apparatus as defined in claim 1, wherein the vibratory drive probe coupling means comprises a fixed member adapted to be rigidly mounted to the underside of the vibratory drive means and a rotatable member rotatably mounted beneath the fixed member, the rotatable member being able to rotate freely in either the clockwise or counter-clockwise direction, the rotatable member having a lower portion for the coupling of sampling tubes.

11. An apparatus as defined in claim 1, further comprising an evacuating means for evacuating hollow probes and drawing materials up through the probes.

12. The apparatus defined in claim 1 wherein the first probe is adopted for vibration drilling and the second probe is adapted to rotary drilling.

13. The apparatus as defined in claim 1, wherein the first probe is the same as the second probe.

14. Drill apparatus convertible between a vibrational drilling mode in which the apparatus is adapted to apply a vibrational force to a sample tube and a rotary drilling mode in which the apparatus is adapted to apply a torsional force to an auger comprising:

a) a drill stand;

b) a carriage assembly mounted to the stand in a vertically sliding fashion;

c) carriage drive means for driving the carriage assembly up and down by application of vertical force thereto;

d) vibratory drive means mountable within the carriage assembly for applying a vertical vibratory force to the sample tube when the vibratory drive means is mounted within the carriage assembly;

e) rotary drive means mountable within the carriage assembly for applying a torsional force to the auger when the rotary drive means is mounted within the carriage assembly;

f) vibratory drive probe coupling means mounted to the vibratory drive means for coupling and decoupling the sample tube to the vibratory drive;

g) rotary drive probe coupling means mounted to the rotary drive means for coupling and decoupling the auger to the rotary drive means;

h) the rotary drive means and the vibratory drive means being interchangeable to permit the apparatus to be converted between a rotary drilling mode and a vibrational drilling mode; and i) support means mounted within the carriage assembly for supporting the vibratory drive probe coupling means within the carriage assembly when the vibratory drive means is mounted therein and for supporting the rotary drive probe coupling means within the carriage assembly when the rotary drive means is mounted therein.

* * * * *